US006457193B1

(12) United States Patent
Li

(10) Patent No.: US 6,457,193 B1
(45) Date of Patent: Oct. 1, 2002

(54) BABY BLANKET

(76) Inventor: Hongbiao Li, 1704 Fernwood, Plano, TX (US) 75075

( * ) Notice: Subject to any disclaimer, the term of this patent is extended or adjusted under 35 U.S.C. 154(b) by 0 days.

(21) Appl. No.: 09/923,700

(22) Filed: Aug. 7, 2001

(51) Int. Cl.[7] ..... A47G 9/02

(52) U.S. Cl. ..... 5/482; 5/505.1; 5/494; 5/498

(58) Field of Search ..... 5/482, 494, 498, 5/504.1, 505.1; 128/872

(56) References Cited

U.S. PATENT DOCUMENTS 739,682 A * 9/1903 Kahl ..... 24/72.5
1,130,781 A * 3/1915 Wiley ..... 5/498
2,284,448 A * 5/1942 Reinholz ..... 128/872
4,975,997 A * 12/1990 Misiura et al. ..... 5/505.1
5,706,532 A * 1/1998 Kettenhofen ..... 40/299.01
5,713,090 A * 2/1998 Rodgers ..... 135/124

FOREIGN PATENT DOCUMENTS

DE 2403103 * 8/1975 ..... 5/498

* cited by examiner

*Primary Examiner*—Michael F. Trettel
(74) *Attorney, Agent, or Firm*—Michael L. Diaz

(57) ABSTRACT

A baby blanket preventing a baby from removing the blanket from the body of the baby. The baby blanket includes a sheet of material having a reinforcing section embedded within a lower portion of a perimeter of the sheet of material. The reinforcing section tapers to an upper portion of the sheet of material to accommodate the shoulders of the baby. The baby blanket also includes a vertically raised section which is located above the neck of the baby. The baby is placed underneath the blanket. The baby is unable to move the blanket away from his body or to move the blanket onto his head.

4 Claims, 2 Drawing Sheets

BABY BLANKET

BACKGROUND OF THE INVENTION

1. Technical Field of the Invention

This invention relates to baby blankets and, more particularly, to a blanket which prevents a baby from removing the blanket from the baby's body.

2. Description of Related Art

It is well known that infants require special care and attention. Infants must be kept at a warmer temperature than what is considered normal for adults. The necessity of keeping the infant warm usually requires that the infant be properly covered or clothed at all times. However, when the infant is sleeping in his crib, other problems are encountered. Normally, parents do not wish to bundle an infant in a lot of clothes when the infant is sleeping because it is uncomfortable for the infant. Therefore, most parents keep the infant warm by placing a blanket over the body of the infant. The infant is kept warm, yet does not require the infant to be bundled in clothing. However, since the infant moves around, the blanket has a tendency to be pushed off the infant. It is not uncommon for parents to continually check the infant to ensure that the blanket is properly covering the infant's body. In other circumstances, sometimes the blanket inadvertently pushed up over the head of the infant, causing breathing difficulty for the infant. In such a situation, it can be quite dangerous for the infant.

There are no existing blankets which prevent the infant from pushing the blanket off his body or preventing the infant from moving the blanket over his head. Some parents have attempted to affix the blanket to the crib, however, the infant's movements are restricted, which bother many infants. In other cases, although the blanket is stationary in relationship to the crib, the infant can still move under the blanket, thus changing the relative position of the infant in regards to the blanket. Thus, it would be a distinct advantage to have a blanket which prevents the infant from removing the blanket or positioning the blanket over his mouth or head. It is an object of the present invention to provide such an apparatus.

SUMMARY OF THE INVENTION

In one aspect, the present invention is a baby blanket for use over a baby. The blanket includes a sheet of material and a reinforcing section affixed to the sheet of material. The reinforcing section provides rigidity to a portion of the blanket. The baby is positioned under the blanket. The reinforcing section prevents the baby from moving the blanket off the baby's body, yet allows restricted movement of the blanket.

In another aspect, the present invention is a baby blanket for use over a baby. The blanket includes a sheet of material and a vertically raised section located on the sheet of material for raising a portion of the sheet of material away from a horizontal surface on which the sheet of material lies. The baby is positioned under the blanket. The vertically raised section prevents the baby from moving the blanket off the baby's body, yet allows restricted movement of the blanket.

In still another embodiment, the present invention is a baby blanket for use over a baby. The blanket includes a sheet of material which is rigid on a portion of a perimeter of the sheet of material. The blanket also includes a vertically raised portion positioned above a portion of the baby. The sheet of material prevents the baby from moving the blanket off the baby's torso.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
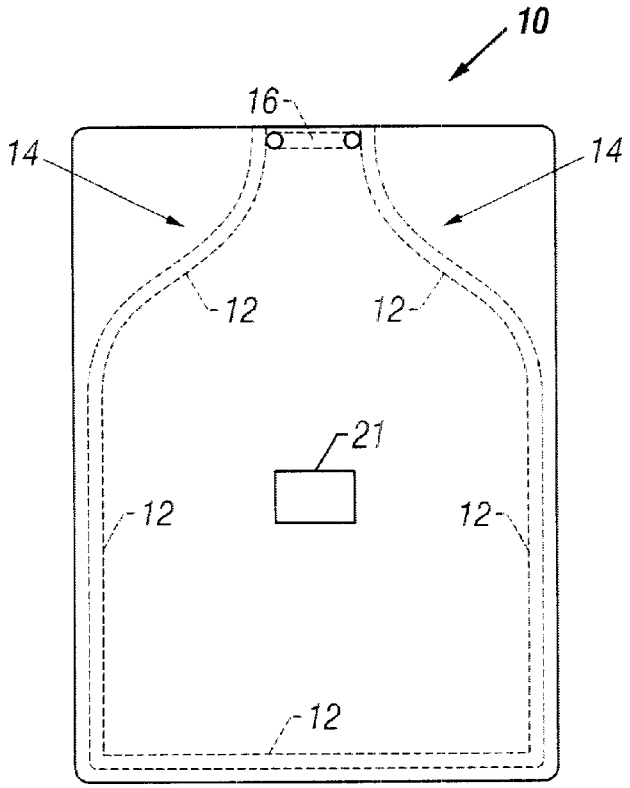
FIG. 1 is a top view of a baby blanket in the preferred embodiment of the present invention.

The present invention is a baby blanket preventing a baby from inadvertently moving the blanket away from the baby's body or covering the baby's head. FIG. 1 is a top view of a baby blanket 10 in the preferred embodiment of the present invention. The blanket includes a flexible reinforcing section 12. The blanket may be constructed of any material. Typically the material is soft and flexible for the comfort of the baby. Preferably, the reinforcing section 12 is embedded within the interior portion of the blanket, thus removing the reinforcing section from view. However, in alternate embodiments of the present invention, the reinforcing section is affixed to an outer surface of the blanket. Preferably, the reinforcing section is located on a perimeter of a lower portion of the blanket. The reinforcing section tapers inwardly toward a top portion of the blanket. The reinforcing section tapes inwardly to form two shoulder sections 14. In the preferred embodiment of the present invention, a vertically raised collar section 16 is located at the top portion of the blanket, in the general vicinity of the shoulder sections. The reinforcing section is preferably constructed of a semi-flexible material providing some rigidity to the blanket to which it is attached. By providing a rigid perimeter on the lower portion of the blanket, the baby cannot remove the blanket away from the baby's body. However, the interior portion of the blanket still allows the baby to move.

Still referring to FIG. 1, the blanket 10 may also include a thermometer 21 indicating the ambient air temperature underneath the blanket. In order to insure that the baby is kept at the proper temperature, the thermometer may be used to indicate to adults via a visual indication showing the temperature or an aural indicator, indicating when the temperature is above or below a desired temperature range. The use of a thermometer and associated visual and aural indicators are well known in the art of temperature measurement devices.

Figure 2:
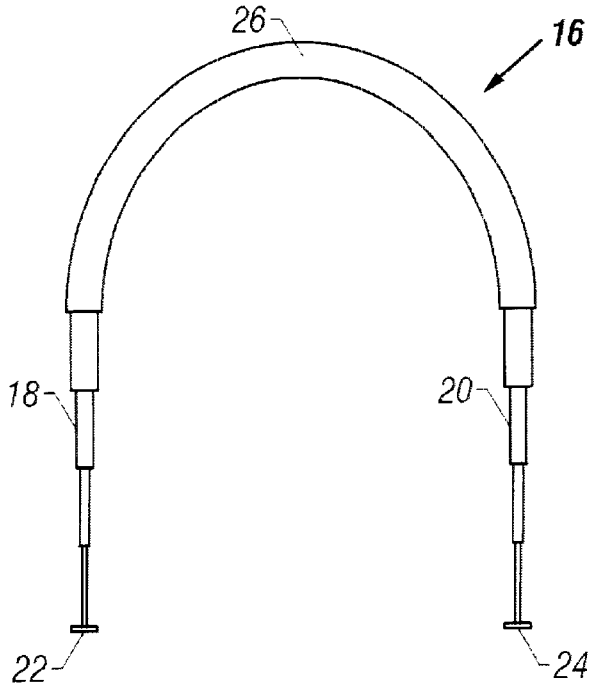
FIG. 2 is a front view of the vertically raised collar section removed from the blanket of FIG. 1.

FIG. 2 is a front view of the vertically raised collar section 16 removed from the blanket 10 of FIG. 1. The raised collar section protrudes vertically upwardly and optionally includes two telescopic platforms 18 and 20. The telescopic platforms may be extended by pushing upwardly when force is applied upwardly on the raised collar section. The telescopic platforms are preferably spring-loaded to a retracted position. When force is removed from the raised collar section, the telescopic platforms are biased toward a retracted position. The telescopic platforms may include ends 22 and 24. The ends are positioned on a flat horizontal surface, such as a crib mattress. In the preferred embodiment of the present invention, the ends are merely positioned on a flat surface, however in alternate embodiments of the present invention, the ends may be affixed to the flat surface, such as with safety pins or an adhesive material. The ends may take any shape which allows the collar section to lie on a flat surface. The raised collar section also includes a curved portion 26 which is sized and shaped to fit over the neck of the baby.

The curved portion 26 of the raised collar section 16 is preferably imbedded within the interior of the blanket 10. However, in alternate embodiments of the present invention, the curved portion may be affixed to an outer surface of the blanket. In the preferred embodiment of the present invention, the telescopic platforms are located on the outside of the blanket and protrude downwardly from a bottom surface of the blanket. In addition, the raised collar section is constructed of a material providing some flexibility and rigidity, such as a pliable plastic. However, any material may be used which allows the blanket to be raised. In addition, it must be understood that the shape of the raised collar section may take any shape and size which prevents the baby from removing the blanket from around his neck. For example, the curved portion may be straight and include ends running perpendicularly down toward the flat surface on which the collar section rests.

Figure 3:
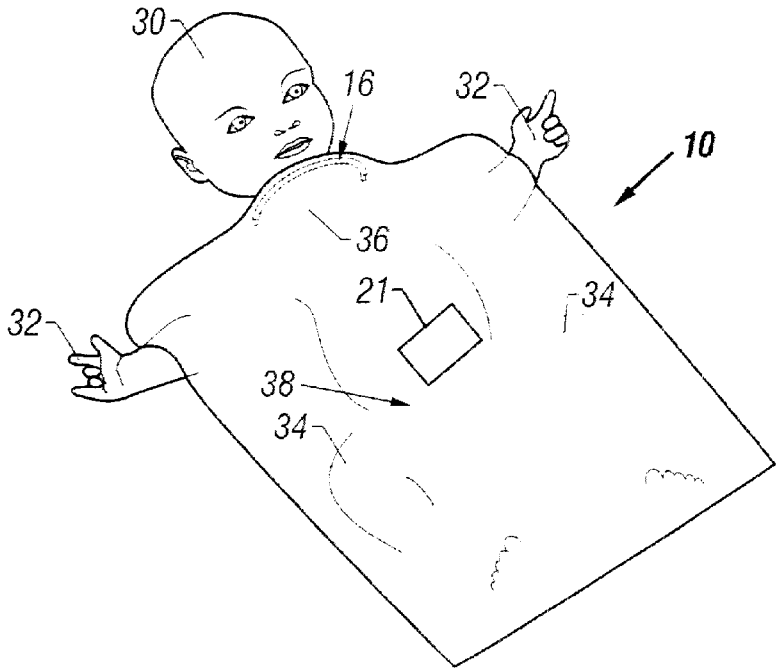
FIG. 3 is a top perspective view of a baby lying underneath the blanket of FIG. 1.

FIG. 3 is a top perspective view of a baby 30 lying underneath the blanket 10 of FIG. 1. The baby includes two arms 32, two legs 34, a neck 36 and a waist 38. The baby is positioned under the blanket with the baby's neck located underneath the raised collar section 16.

With reference to FIGS. 1-3, the operation of the blanket 10 will now be explained. The baby 30 is positioned under the blanket in such a manner as to locate the baby's neck 36 under the vertically raised collar section 16. When the baby moves, as babies customarily do when lying down, the blanket remains on the body of the baby. The baby's arms 32 or legs cannot remove or push the blanket off his body because the reinforcing section 12 provides some rigidity to a portion of the blanket, thus preventing the baby from pushing the entire blanket away from his body. However, the reinforcing section still allows the baby to move underneath the blanket and move the interior portion of the blanket, which does not completely restrict the baby. The vertically raised collar section prevents the baby from moving the blanket, either onto the baby's head or away from the baby. Yet, because the vertically raised collar section rises above the baby, the baby is not weighted down. In the preferred embodiment of the present invention, the vertically raised collar section provides enough room for the baby to move yet prevent the head of the baby from sliding under the collar section. When the baby pushes upwardly on the upper portion of the blanket, the telescopic platforms 18 and 20 extend upwardly, thus provided some restricted movement of the blanket by the baby. The ends remain on the flat surface (mattress), thus providing stability to the blanket in relationship to the flat surface. The shoulder sections allow the baby to position his arms above the blanket without being weighed down by the reinforcing section, if the baby so desires. In addition, the blanket allows the baby to turn over onto his stomach, yet still keep the blanket positioned on the body of the baby.

Figure 4:
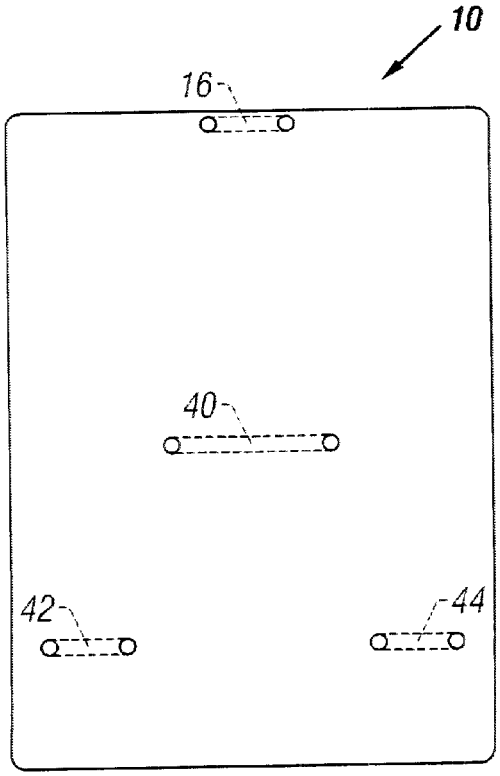
FIG. 4 is a top view of the blanket in an alternate embodiment of the present invention.

FIG. 4 is a top view of the blanket 10 in an alternate embodiment of the present invention. In this alternate embodiment, the blanket includes a vertically raised waist section 40 and two vertically raised leg sections 42 and 44. The vertically raised sections are similar to the vertically raised collar section with the exception of being located at different positions on the blanket. As illustrated in FIG. 4, the vertically raised waist section is located above the waist of the baby while the vertically raised leg sections are located above the thighs of the baby. It must be understood, that vertically raised sections may be located anywhere on the blanket and with any selected numbers as desired to prevent the baby from removing the blanket.

The blanket may also be used for adults or older children where it is desired to keep the blanket over the body of the person. In such alternate embodiments, the size of the blanket is enlarged, to included heavier reinforcing sections, in order to accommodate a larger person.

The baby blanket 10 provides many advantages over existing baby blankets. The blanket allows the baby to be safely positioned under the blanket without allowing the baby to remove the blanket from his body or pushing the blanket over the baby's head. In addition, the blanket is not so immobile as to restrict the movements of the baby while lying underneath the blanket. The blanket allows the baby to flip over onto his stomach or his back as the baby desires, while still keeping the blanket properly positioned on the baby.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A baby blanket for use over a baby, the blanket comprising:

a sheet of material; and a reinforcing section affixed to the sheet of material, said reinforcing section providing a rigidity to a portion of the blanket, wherein the reinforcing section is positioned on a perimeter of a lower portion of the sheet of material and tapers to a top portion of the sheet of material to accommodate movement of arms of the baby;

whereby the baby is positioned under the blanket, said reinforcing section preventing the baby from moving the blanket off a body of the baby while allowing restricted movement of the blanket.

2. A baby blanket for use over a baby, the blanket comprising:

a sheet of material;

a vertically raised section located on the sheet of material for raising a portion of said sheet of material away from a horizontal surface on which said sheet of material lies, wherein said vertically raised section includes a plurality of telescopically extendable legs, the legs being positioned on the horizontal surface; and a reinforcing section affixed to the sheet of material, said reinforcing section providing a rigidity to a portion of the blanket;

whereby the baby is positioned under the blanket, said reinforcing section preventing the baby from moving the blanket off a body of the baby while allowing restricted movement of the blanket.

3. The blanket of claim 2, wherein each extendable leg is affixed to the horizontal surface.

4. A baby blanket for use over a baby, the blanket comprising:

a sheet of material; and a vertically raised section located on the sheet of material for raising a portion of said sheet of material away from a horizontal surface on which said sheet of material lies, wherein said vertically raised section includes a plurality of telescopically extendable legs, the legs being positioned on the horizontal surface;

whereby the baby is positioned under the blanket, said vertically raised section preventing the baby from moving the blanket off a body of the baby yet allowing restricted movement of the blanket.

* * * * *